US008668009B2

(12) United States Patent
Lourenco et al.

(10) Patent No.: US 8,668,009 B2
(45) Date of Patent: Mar. 11, 2014

(54) METHOD AND APPARATUS FOR CONTROLLING A VOLUME OF HYDROGEN INPUT AND THE AMOUNT OF OIL TAKEN OUT OF A NATURALLY OCCURRING OIL FIELD

(75) Inventors: Jose J. P. Lourenco, Edmonton (CA); John Gordon Murphy, St. James (BB)

(73) Assignee: Agosto Corporation Ltd., Road Town, Tortola (VG)

( * ) Notice: Subject to any disclaimer, the term of this patent is extended or adjusted under 35 U.S.C. 154(b) by 203 days.

(21) Appl. No.: 13/235,745

(22) Filed: Sep. 19, 2011

(65) Prior Publication Data

US 2012/0261123 A1 Oct. 18, 2012

Related U.S. Application Data

(60) Provisional application No. 61/476,480, filed on Apr. 18, 2011.

(51) Int. Cl.

| | |
|---|---|
| ***E21B 43/24*** | (2006.01) |
| ***E21B 43/16*** | (2006.01) |
| ***E21B 21/06*** | (2006.01) |

(52) U.S. Cl.

USPC ..... 166/272.3; 166/75.12; 166/267; 166/401

(58) Field of Classification Search

None

See application file for complete search history.

(56) References Cited

U.S. PATENT DOCUMENTS

| | | | | |
|---|---|---|---|---|
| 5,626,191 | A | 5/1997 | Greaves et al. | |
| 6,357,526 | B1 | 3/2002 | Abdel-Halim et al. | |
| 6,412,557 | B1 | 7/2002 | Ayasse et al. | |
| 7,547,423 | B2 | 6/2009 | Sprouse et al. | |
| 2010/0181069 | A1 | 7/2010 | Schneider et al. | |
| 2010/0212894 | A1 | 8/2010 | Latimer et al. | |
| 2011/0000671 | A1 * | 1/2011 | Hershkowitz et al. | 166/305.1 |
| 2012/0161451 | A1 * | 6/2012 | Struble et al. | 290/1 R |

* cited by examiner

*Primary Examiner* — Zakiya W Bates

(74) *Attorney, Agent, or Firm* — Sand & Sebolt

(57) ABSTRACT

A system and method for cracking, hydrogenating and extracting oil from underground deposits is presented. A method includes injecting a mixture of oxygen, steam and oil into an injection well to upgrade oil in an oil deposit below ground to decrease the viscosity of the oil to product upgraded oil. The upgraded oil is extracted with a production well to bring upgraded oil aboveground. The method monitors at least one characteristic of the upgraded oil to determine when the at least on characteristic exceed a threshold. The mixture of oxygen, steam and oil is adjusted when the at least one characteristic exceeds the threshold value so that the mixture of oxygen, steam and oil does not exceed the threshold.

20 Claims, 4 Drawing Sheets

METHOD AND APPARATUS FOR CONTROLLING A VOLUME OF HYDROGEN INPUT AND THE AMOUNT OF OIL TAKEN OUT OF A NATURALLY OCCURRING OIL FIELD

CROSS REFERENCE TO RELATED APPLICATION

This application claims priority from U.S. Provisional Application Ser. No. 61/476,480 filed Apr. 18, 2011; the disclosure of which is incorporated herein by reference.

BACKGROUND OF THE INVENTION

1. Field of Invention

The current invention relates generally to apparatus, systems and methods for extracting oil. More particularly, the apparatus, systems and methods relate to extracting oil from underground deposits. Specifically, the apparatus, systems and methods provide for syngas assisted oil recovery, including at least partially cracking and hydrogenating the oil with syngas.

2. Description of Related Art

A variety of processes are used to recover viscous hydrocarbons such as heavy oil and bitumen from underground deposits. Typically, methods are used in heavy oil or bitumen that are greater than 50 meters deep where it is no longer economic to recover the hydrocarbon by current surface mining technologies. Depending on the operating conditions of the insitu process and the geology of the heavy oil or bitumen reservoir, insitu processes can recover between 25% and 75% of the oil. The primary focus associated with producing hydrocarbons from such deposits is to reduce the insitu viscosity of the heavy oil or bitumen so that it can flow from the reservoir to the production well. The reduction of the insitu heavy oil or bitumen is achieved by raising the temperature and/or dilution with solvent, which is the typical practice in existing processes.

The Steam Assisted Gravity Drainage (SAGD) is a popular insitu recovery method which uses two horizontal wells (a well pair) positioned in the reservoir to recover hydrocarbons. This method is far more environmentally benign than oil sands mining. In this process, the two wells are drilled parallel to each other by using directional drilling. The bottom well is the production well and is typically located just above the base of the reservoir. The top well is the injection well and is typically located between 15 and 30 feet above the production well. Anywhere between 4 and 20 well pairs are drilled on a particular section of land or pad. All the well pairs are drilled parallel to one another, about 300 feet apart, with half of the well pairs oriented in one direction, and the other half of the well pairs typically oriented 180° in the opposite direction to maximize reservoir coverage. A 15 foot meter separation is often an optimal gap which allows for the maximum reservoir production due to the most effective impact of the injected steam. Although the separation between injector and producer wells are planned for 15 foot, some wells have as high as 30 foot gaps, reducing production capability from that particular zone.

The top well injects steam into the reservoir from the surface. In the reservoir, the injected steam flows from the injection well and looses its latent heat to the cool heavy oil and bitumen and as a result the viscosity of the heated heavy oil and bitumen drops and flows under gravity towards the production well located below the injection well.

Given the quantity of steam required for the SAGD, energy needed for the steam generation represents a substantial cost for the SAGD. In addition to the cost, other criteria of the steam generation for the SAGD relate to production of carbon dioxide ($CO_2$) and water input requirements. For example, many governments regulate $CO_2$ emissions. High costs relative to another option for the steam generation can prevent use of some options for the steam generation regardless of ability to provide desired criteria, such as with respect to the production of $CO_2$. Burning gas or oil to fuel burners that heat steam generating boilers creates $CO_2$, which is a greenhouse gas that can be captured by various approaches. While further adding to the cost, capturing the $CO_2$ from flue gases of the burners facilitates in limiting or preventing emission of the $CO_2$ into the atmosphere. In contrast to indirect heating with the boilers, prior direct combustion processes inject steam and $CO_2$ together into the formation even though injection of the $CO_2$ into the formation may not be desired or acceptable in all applications.

Regarding the water input requirements, inability to recycle all of the steam injected results from having to remove impurities such as sodium chloride from any recovered water prior to the recovered water being combined with other make-up water to feed any steam generation. Limited water supplies for the make-up water at locations of where SAGD is applicable can prevent feasibility of the steam generation. Even if available, expense of purchasing water can incur cost for the SAGD.

Typically, the SAGD process is considered thermally efficient if its Steam to Oil Ratio (SOR) is 3 or lower. The SAGD process requires about 1,200 cubic feet of natural gas to heat the water to produce 1 barrel of bitumen. As of the end of 2010, the National Energy Board (NEB) of Canada estimates the capital cost of $18-$22 to produce a barrel of bitumen by the SAGD method. Because of the high ratio of water requirement for the SAGD, an alternative process, method or system to reduce water consumption is desirable.

An alternative process that reduces steam usage is an extension of the SAGD process, the Steam and Gas Push (SAGP) where steam and a non-condensable gas are co-injected into the reservoir. The non-condensable gas provides an insulating layer and improves the thermal efficiency of the process, resulting in a reduction of steam.

Another extension of the SAGD process uses a solvent, called Vapor Extraction (VAPEX). Similar to SAGD, VAPEX consists of two horizontal wells positioned in the reservoir, whereas the top well is the injection well and the bottom well is the production well. In VAPEX, a gaseous solvent such as propane is injected into the reservoir instead of steam. The injected solvent condenses and mixes with the heavy oil or bitumen to reduce its viscosity. Under the action of gravity, the mixture of solvent and bitumen flow towards the production well and are pumped to the surface. A major concern with the VAPEX process is how to control the significant solvent losses to the reservoir, which has a tremendous impact on its economics. Therefore, a better way of extracting heavy oil and bitumen from underground deposits is desired.

SUMMARY OF THE INVENTION

The preferred embodiment of the invention includes a system for cracking, upgrading and extracting oil from underground deposits is presented. The system includes a gasifier, an injection well and a production well. The gasifier creates high pressure, high temperature syngas. The high pressure, high temperature syngas flows through the injection well into a deposit of oil under, the ground to crack and hydrogenate the oil to produce upgraded oil with a reduced density and viscosity. The production well of the system receives the reduced density and viscosity oil and transports it above the ground where it may be further separated into a portion that may be sold and a portion that can be gasified in the gasifier. The system can be configured as a syngas assisted gravity drainage (SYAGD) system of oil recovery. In an SYAGD system, the injection well outputs the syngas above an input of the production well so that the reduced viscosity oil can flow downward into an input of the production well.

In another configuration of the preferred embodiment, the gasifier includes an oxygen input, an oil input and a steam input. Oxygen is input to the gasifier through the oxygen input, oil is input to the gasifier through the oil input and steam is input into the gasifier through the steam input. The gasifier mixes the oxygen, oil and gas to product the syngas.

In one configuration of the preferred embodiment, the gasifier creates a syngas comprised of hydrogen and carbon monoxide. The ratio of hydrogen to carbon monoxide is about 2 to 1. In another configuration of the preferred embodiment, the ratio of hydrogen to carbon monoxide is about 3 to 1.

Another configuration of the system for cracking, hydrogenating and extracting oil from underground deposits includes an oxygen compressor and an emulsification vessel. The oxygen compressor creates a stream of high pressure gasification oxygen and a stream of high pressure atomizing oxygen. The emulsification vessel mixes a stream of oil with the stream of high pressure atomizing oxygen to produce mixed oil. The mixed oil, high pressure gasification oxygen and steam are input to the gasifier.

Another configuration of the system includes a heat recovery unit (HRU). The HRU reduces and controls the temperature of the syngas before it is injected to the deposit of oil. The system can also include a closed loop system to recover the heat given up by the syngas at the HRU as recovered heat to convert the recovered heat into electricity. The closed loop system can be an organic rankine cycle (ORC) system.

The closed loop system can include a generator, a heat exchanger, an expander turbine and an air heat exchanger. The heat exchanger heats and vaporizes a liquid to create a vaporized liquid. The expander turbine receives the vaporized liquid and generates shaft power to rotate the generator. The generator produces electricity. The air heat exchanger cools the vaporized liquid back into a liquid by exchanging heat with air. The liquid can be a refrigerant.

Another configuration of the preferred embodiment includes a system with a gasification unit, a compressed oxygen line, an oil line, a steam line, an injection well and a production well. The compressed oxygen line carries compressed oxygen into the gasification unit, the oil line carries oil into the gasification unit and the steam line carries steam into the gasification unit. The gasification unit gasifies the compressed oxygen, oil and steam to produce a syngas stream. The injection well carries the syngas stream to an underground deposit of oil where the syngas cracks and hydrogenates oil in the deposit to produce upgraded oil and the production well recovers the upgraded oil and transports the upgraded oil above ground. This system can include a heat recovery unit to reduce and control the temperature of the syngas stream before it is sent to the injection well

BRIEF DESCRIPTION OF SEVERAL VIEWS OF THE DRAWINGS

One or more preferred embodiments that illustrate the best mode(s) are set forth in the drawings and in the following description. The appended claims particularly and distinctly point out and set forth the invention.

The accompanying drawings, which are incorporated in and constitute a part of the specification, illustrate various example methods, and other example embodiments of various aspects of the invention. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

Figure 1:
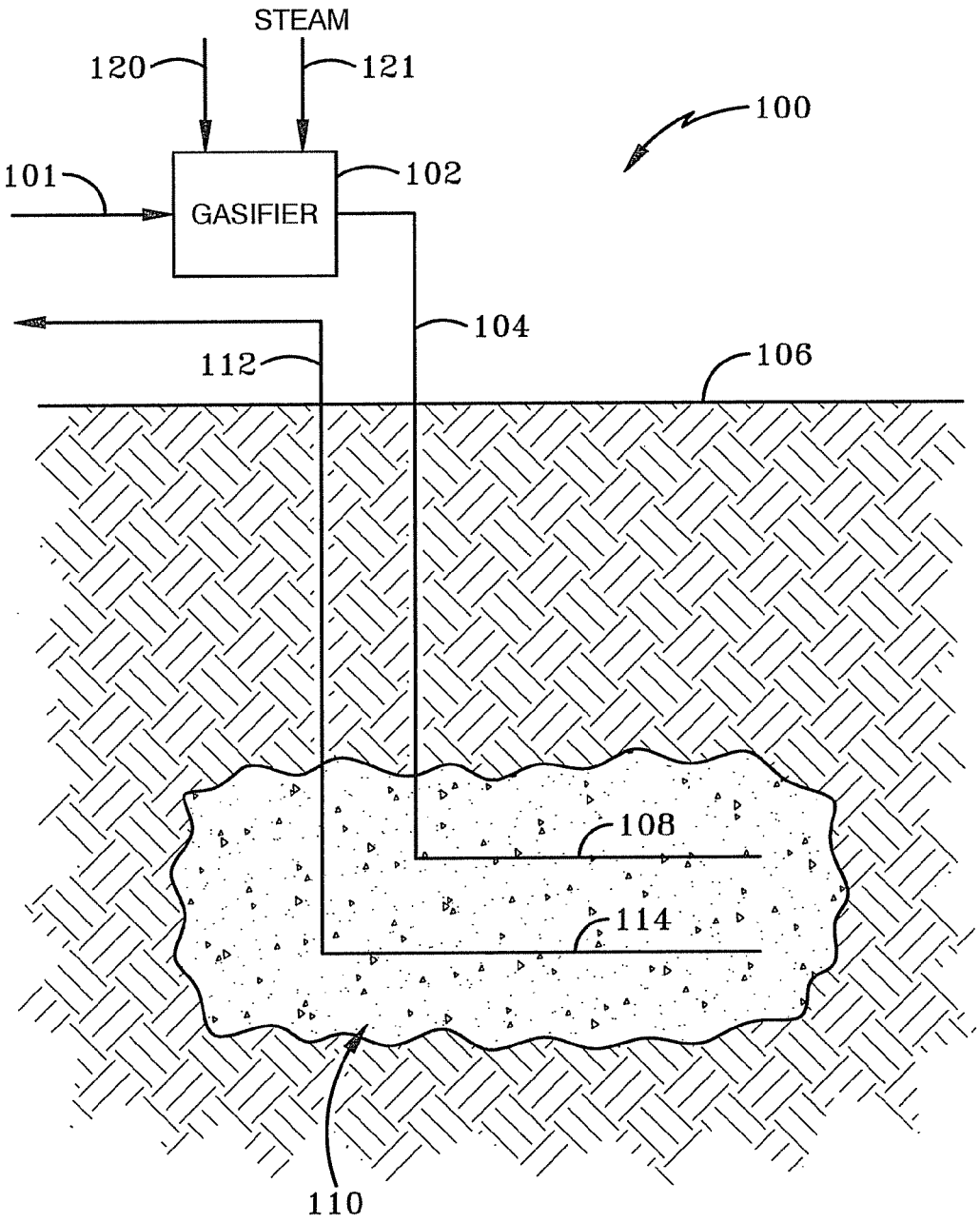
FIG. 1 illustrates a preferred embodiment of a system for upgrading and extracting heavy oil from underground.

FIG. 1 illustrates a first configuration of the preferred embodiment of a system 100 for upgrading bitumen, heavy oil or another oil and extracting them from a reservoir 110. FIG. 1 illustrates a configuration of the preferred embodiment of the system that generates a syngas with a rather high temperature and pressure that is injected into an injection well. While it may not be practical to inject syngas with such high temperatures and pressures, this Figure is useful for understanding some of the novelty of the invention. After FIG. 1 is discussed, other figures that implement more detailed and more practical systems and methods such as those which reduce the temperature of the syngas before it is injected into a well are discussed further.

In FIG. 1, fuel is input to a high pressure gasifier 102 through a feed line 101 along with oxygen from line 120 and steam from line 121. The fuel is partially burned in the gasifier with the oxygen and steam to generate a high temperature, high pressure syngas. The high temperature and high pressure syngas includes primarily hydrogen and carbon monoxide. In this configuration of preferred embodiment, the ratio of hydrogen to carbon monoxide in the syngas is in the range of 2 to 3:1. The high pressure gasifier 102 that generates the syngas can be a market available high pressure gasifier such as the ZEEP (Zero Emissions Energy Plant) gasifier developed by Pratt and Whitney Rocketdyne. U.S. Pat. No. 7,547,423 describes other aspects of a high pressure gasifier the contents of which are incorporated herein by reference. The system 100 injects the syngas at a controlled temperature into the reservoir 110 to heat, crack, hydrogenate and upgrade heavy oil insitu. Cracking the heavy oil in the presence of hydrogen can prevent or reduce the formation of coke.

The syngas is transported through an upper well line 104 that transports it below the Earth's surface 106 to an upper region of an oil reservoir 110. The upper well line 104 may be connected to an upper well horizontal line 108 that can have openings periodically placed in the horizontal line 108 to distribute the syngas at periodic intervals within the reservoir 110. The heated hydrogen and carbon monoxide of the syngas entering the reservoir 110 heats up, cracks and hydrogenates heavy oil within the reservoir providing a higher recovery rate than a typical SAGD system. The cracked and hydrogenated heavy oil has a lower density and viscosity that allows it to flow generally downward toward a lower well horizontal line 114. The lower well horizontal line 114 can have holes periodically placed in it to allow the cracked oil to flow into these holes. The cracked oil can then be extracted through a vertical well line 112 and brought to the surface of the earth for further processing and/or storage.

The system 100 for upgrading and extracting heavy oil of FIG. 1 has several benefits over a traditional SAGD system. The system 100 uses very little water consumption, the consumed steam is the raw material for the generation of hydrogen through water gas shift reaction. Unlike a typical SAGD, system 100 for upgrading and extracting heavy oil creates little to no emissions, because the products of gasification are injected into the well. The formation of hydrogen in the syngas aids in the hydrogenation of the cracked heavy oil, upgrading it and minimizing the formation of coke. Because hydrogen has a heat capacity of 14.3 J/g·K versus 2.08 for steam, it provides for superior heat transfer to the oil reservoir 110. Additionally, the system 100 can have no external fuel requirements or associated infra-structure because it can use a slipstream of the produced oil bottoms fraction as fuel which results in lower capital and operating costs per barrel of bitumen produced. Using a slipstream to eliminate or significantly reduce external fuel requirements is discussed in detail below with reference to the system 200 of FIG. 2.

Figure 2:
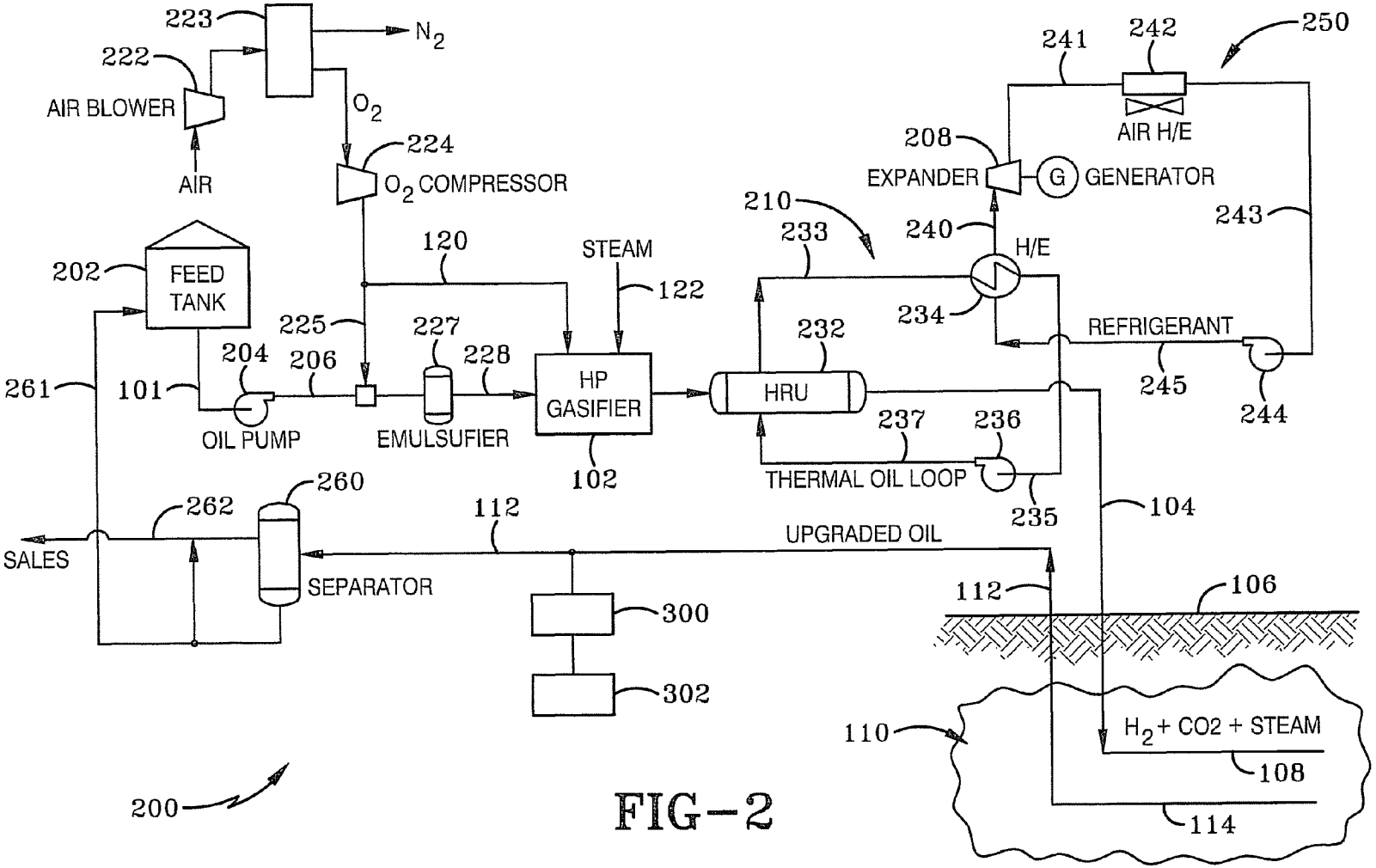
FIG. 2 illustrates in more detail the preferred embodiment of the system for upgrading and extracting heavy oil from underground.

FIG. 2 illustrates a second configuration of the preferred embodiment of a system 200 for upgrading bitumen, heavy oil or another oil and extracting them from a reservoir 110. Similar to the system 100 of FIG. 1, the system 200 of FIG. 2 includes a high pressure gasifier 102 to generate a high temperature, high pressure syngas of primarily hydrogen and carbon monoxide. Unlike the system of FIG. 1, the system 200 of FIG. 2 includes an ORC system 250 with a hot oil circulating loop to allow for the temperature of the syngas to be lowered and to provide thermal energy to an ORC power generation unit 208. The components of the ORC system 250 and the details of how it operates are discussed below. Lowering the temperature of the syngas allows it to be injected at temperatures between 300° C. and 500° C. into the reservoir reducing the need to have extremely high performance piping and equipment that would be required at higher pressures and temperatures. Similar to the system of FIG. 1, the conditioned high pressure hydrogen and carbon monoxide syngas is routed to the injection well through lines 104 and 114 to heat the formation, crack the heavy oil in the formation and react with the hydrogen in the presence of a natural catalytic environment of fine clays and sand to upgrade bitumen and/or heavy oil in the production well. Again, the high pressure gasifier 102 may be a Pratt and Whitney Rocketdyne ZEEP gasifier or another type of gasifier as understood by those of ordinary skill in the art.

Before describing further details of the system 200 for upgrading bitumen, heavy oil or another oil, some of the improvements of this system are discussed over prior systems. Whereas a typical SAGD system is limited to heating the oil formation to reduce the oil viscosity, the system of FIG. 2 provides the capability for the heating, cracking, hydrogenating and upgrading of heavy oil. Moreover, the system 200 of FIG. 2 can meet on demand temperatures required in the oil formation whereas the SAGD process temperature is limited to the rating of the steam generator pressure which sets the temperature of the injection into the reservoir. The system 200 for upgrading bitumen, heavy oil or another oil, can generate a wide range of injection temperatures on demand. This ability to control injection temperature allows for better control of production and larger gaps between injector and producing wells. As a result, it can reduce capital costs substantially. Little to no external power is required to power the system 200 because the system 200 generates its own power by recovery of thermal energy in controlling the temperature of the syngas to reservoir 110.

The system 200 for upgrading bitumen, heavy oil or another oil of FIG. 2 includes an air blower 222, a molecular sieve 223 and an oxygen compressor 224 to generate a high concentration oxygen stream to provide the oxygen requirements for the incomplete combustion of the fuel in the gasifier 102. The air blower 222 is provided to first pressurize atmospheric air. A line carries the compressed air to the molecular sieve 223 where it is separated into $O_2$ and nitrogen. The nitrogen is released into the atmosphere or it can be recovered if desired. The oxygen compressor 224 further compresses the highly concentrated oxygen. The compressed oxygen leaves the compressor 224 on line 228 which splits into a gasification oxygen line 120 and an atomizing oxygen line 125.

The system 200 for upgrading bitumen, heavy oil or another oil includes a feed tank 202 for storing oil reclaimed from the reservoir 110. A portion of this stored oil from the feed tank 202 is carried from the input line 101 to a high pressure oil pump 204 that pumps it into line 206. Compressed atomizing $O_2$ from line 225 and the feed oil in line 206 are combined and passed through line 226 to an emulsifier vessel 227 where they are mixed together.

Steam in line 121, gasification oxygen in line 120 and the emulsified oxygen and oil in line 228 all enter the high pressure gasifier 102 where they are combined to generate a high pressure, high temperature syngas. As previously mentioned when discussing FIG. 1, the gasification generates about a 2 to 3:1 ratio of hydrogen and carbon monoxide. Those of ordinary skill in the art will realize that this ratio is selectable and can be other ranges or values. Before the high pressure, high temperature syngas is injected down line 104 to the reservoir, line 230 first carries it to a gasifier heat recovery unit (HRU) 132 to control (e.g., lower) the syngas temperature.

Power is generated in an organic rankine cycle (ORC) system 250 which converts the thermal energy captured in the gasifier HRU 132 into electricity. The ORC system 250 includes an ORC heat exchanger 234, line 240, a generator 208, line 241, an air heat exchanger 242, line 243, a refrigerant pump 244 and line 245. The ORC system 250 receives its energy from a closed loop hot oil circulation system including the gasifier HRU 232, line 233, the ORC heat exchanger 234, line 235, pump 236, line 237 and the gasifier HRU 232.

The oil circulating system 250 controls the temperature of the syngas for injection into the reservoir 110. The temperature of the syngas is controlled by feeding hot circulating oil in line 233 into the ORC heat exchanger 234 where it gives up its thermal energy. Line 233 transfers heat from the HRU 232 to the ORC heat exchanger resulting in a cooling of the syngas exiting the HRU on line 104. The cooled circulating oil travels in line 235 to an oil pump 236. Then pump 236 pumps the oil through line 237 to a heating coil in the gasifier HRU 237 to complete this loop.

In another closed loop, a low boiling point fluid (a refrigerant) is pumped by refrigerant pump 244 at a high pressure in line 245 to the ORC heat exchanger 234 where it is vaporized to form a high pressure, low boiling point gaseous fluid. This high pressure, low boiling point fluid gaseous stream enters, from line 240, an expander turbine so that it can provide shaft horsepower to the generator 208 to provide rotation to an electrical generator. The rotating electrical generator can then produce electricity to power the overall system 200 for upgrading bitumen, heavy oil or another oil. Line 241 carries the lower energy stream after it passed through the generator 208 to the air heat exchanger 242. At the air heat exchanger 242, the lower energy stream is further cooled. Line 243 carries the stream from the air heat exchanger 242 back to the pump 244 where the cycle begins to repeat in another cycle.

The system 200 for upgrading heavy oil pumps the conditioned heavy oil from the HRU 232 in line 104 down to the oil reservoir 110. The syngas is generally injected into line 104 for travel to the reservoir 110 at about 300° C. to 500° C. Similar to the discussion above with reference to system 100, the injected syngas heats up the oil formation, cracking, hydrogenating and upgrading the heavy oil, decreasing its density and viscosity allowing it to flow into the production well (e.g., lines 112 and 114). The system 200 utilizes the natural catalytic bed of the formation to aid the rate of reaction. For example, the reservoir minerals are composed of clay minerals and non-clay minerals, the clay minerals, such as kaolinites and montmorillonite, are the main catalysts in the process of hydrocarbon source rock organic compounds. Moreover the elements of aluminium, iron and potassium present in the matrices are known to promote catalysis oxidation, decarboxylation and hydrogenation of organic compounds.

Figure 3A:
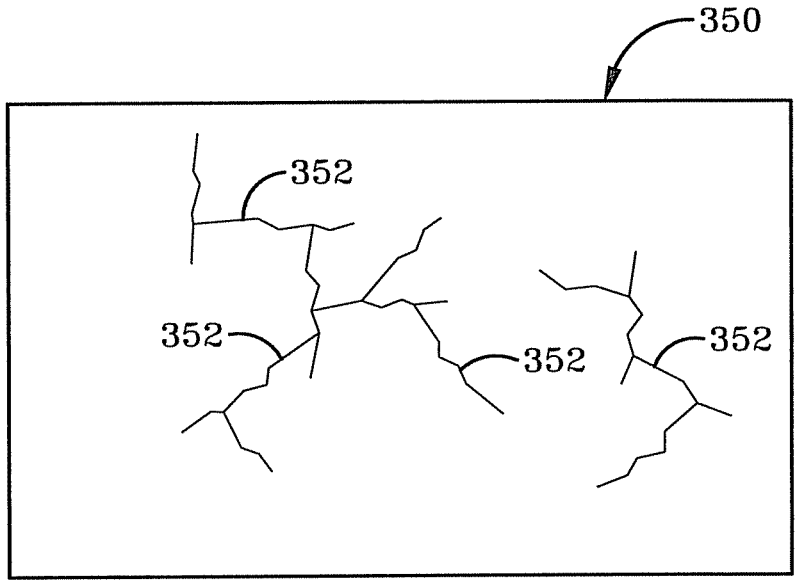
FIGS. 3A and 3B illustrate how to use the system for upgrading and extracting heavy oil from underground increase the geological matrix to allow oil to more easily flow through the matrix.
Figure 3B:
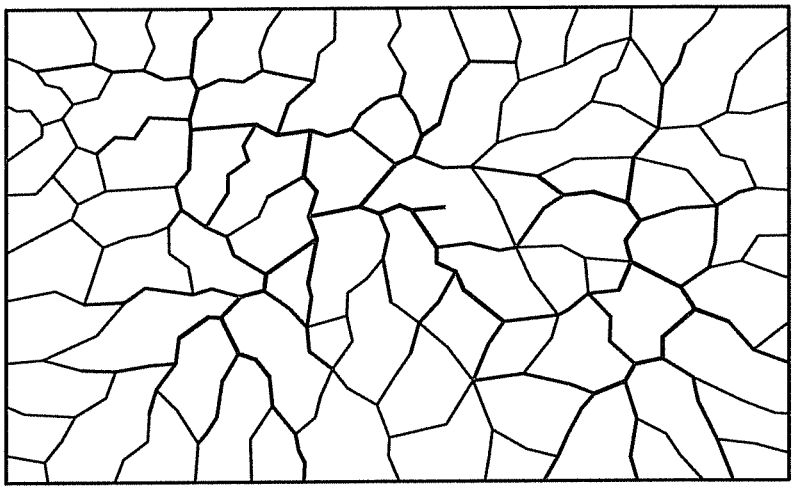

The high pressure, high temperature gasifier 102 can be controlled so that the generated syngas includes carbon dioxide. When the syngas steam condenses in the reservoir 110 it combines with the carbon dioxide to form carbonic acid. Referring to FIGS. 3A/B, the carbonic acid dissolves the cement bridges 352 between quartz particles and thus increases the pore space at the geological matrix in the reservoir which will allow the passage (increases the release) of more oil toward the output well lines 112 and 114 increasing the production of the reservoir. FIG. 3A illustrates a blown up example of a geological matrix before the creation of carbonic acid and FIG. 3B illustrates what the same geological matrix may look like after it has interacted with carbonic acid. Dissolution of $CO_2$ in the formation water results in the formation of carbonic acid, which in turn dissolve the formation minerals during injection, this process improves formation permeability.

Additional carbon dioxide can be injected into the reservoir to further act as a pressurizing agent and when dissolved underground in the heavy oil, it significantly reduces its viscosity, enabling the oil to flow more easily through the wider pore formation into the production well. The system may leave this carbon dioxide underground in the deposit after the oil has been extracted.

The amount of hydrogen that is injected into the reservoir 110 by lines 104 and 108 affect the cracking hydrogenation reactions process and the quality of the oil extracted from the reservoir 110. Therefore, the system 200 for upgrading bitumen, heavy oil or another oil can include an API gravity meter 300 for monitoring the quality of upgraded oil being extracted from the reservoir 110. The API gravity can be monitored and when it falls out of range of values that system 100 is monitoring, a controller 302 can be configured to adjust the amount of oxygen, steam and/or oil input to the high pressure gasifier 102 to control; the amount and composition of hydrogen in syngas stream; the pressure and temperature of the syngas being injected into the reservoir 110 to move the API gravity to a more acceptable range.

Lines 112 and 114 carry the upgraded oil that is recovered in the production well and carry it aboveground to a separator 260. The separator 260 splits the produced upgraded oil into two streams. Line 261 carries a portion of the heavy ends for gasification and line 262 carries the light ends for sales.

Example methods may be better appreciated with reference to flow diagrams. While for purposes of simplicity of explanation, the illustrated methodologies are shown and described as a series of blocks, it is to be appreciated that the methodologies are not limited by the order of the blocks, as some blocks can occur in different orders and/or concurrently with other blocks from that shown and described. Moreover, less than all the illustrated blocks may be required to implement an example methodology. Blocks may be combined or separated into multiple components. Furthermore, additional and/or alternative methodologies can employ additional, not illustrated blocks.

Figure 4:
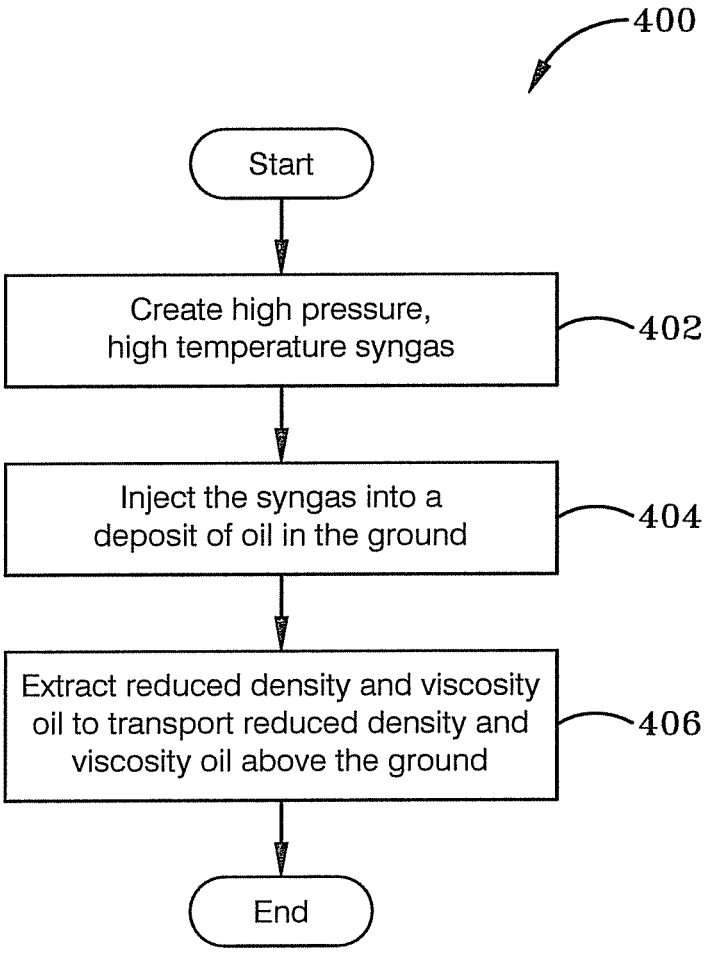
FIG. 4 illustrates a configuration of the preferred embodiment represented as a method for upgrading and extracting heavy oil from underground.

FIG. 4 illustrates a configuration of the preferred embodiment as a method 400 for cracking and extracting oil beneath the ground. The method 400 is especially well suited to extract oil from deposits beneath the earth's surface. The method 400 begins by creating a high pressure, high temperature syngas, at 402. As previously mentioned, the syngas can be created by partial combustion of a mixture of oil, oxygen and steam in a gasifier. Next, the syngas is injected into a deposit of oil under the ground, at 404, to crack and hydrogenate the oil to produce upgraded oil with a reduced viscosity. Some configurations of the method 400 will cool the syngas in a heat recovery unit before it is pumped below ground. The reduced viscosity oil is extracted and brought above the ground, at 406. This oil can be separated into light oil that is ready for sales and heavier oil that can be used to create the syngas in a gasifier.

In the foregoing description, certain terms have been used for brevity, clearness, and understanding. No unnecessary limitations are to be implied therefrom beyond the requirement of the prior art because such terms are used for descriptive purposes and are intended to be broadly construed. Therefore, the invention is not limited to the specific details, the representative embodiments, and illustrative examples shown and described. Thus, this application is intended to embrace alterations, modifications, and variations that fall within the scope of the appended claims.

Moreover, the description and illustration of the invention is an example and the invention is not limited to the exact details shown or described. References to "the preferred embodiment", "an embodiment", "one example", "an example", and so on, indicate that the embodiment(s) or example(s) so described may include a particular feature, structure, characteristic, property, element, or limitation, but that not every embodiment or example necessarily includes that particular feature, structure, characteristic, property, element or limitation. Furthermore, repeated use of the phrase "in the preferred embodiment" does not necessarily refer to the same embodiment, though it may.

What is claimed is:

1. A method for extracting oil from an underground oil deposit comprising:

injecting a mixture of oxygen, steam and oil into an injection well to upgrade oil in an oil deposit below ground to decrease the viscosity of the oil to produce upgraded oil, wherein the mixture provides hydrogen to hydrogenate with oil in the oil deposit;

extracting the upgraded oil with a production well to bring upgraded oil aboveground;

monitoring at least one characteristic of the upgraded oil to determine when the at least on characteristic exceed a threshold; and adjusting the mixture of oxygen, steam and oil when the at least one characteristic exceeds the threshold value so that the mixture of oxygen, steam and oil does not exceed the threshold.

2. The method of claim 1 wherein the adjusting further comprises:

adjusting the at least one of: the temperature and the pressure of the mixture of oxygen, steam and oil when the at least one characteristic exceeds the threshold value.

3. The method of claim 1 wherein the adjusting further comprises:

adjusting the amount of the mixture of oxygen, steam and oil injected into the injection well.

4. The method of claim 1 wherein the injecting further comprises:

injecting a mixture of oxygen, steam and oil that has been partially combusted to form a syngas.

5. The method of claim 4 wherein the injecting further comprises:

injecting the syngas into the injection well so that the syngas at least partially hydrogenates and cracks the oil in the oil deposit.

6. The method of claim 1 wherein the injecting further comprises:

injecting the mixture of oxygen, steam and oil into the injection well that releases the mixture above a collection point at which the production well collects the upgraded oil.

7. The method of claim 1 further comprising:

combusting the mixture of oxygen, steam and oil to produce a syngas; and recovering heat from the syngas before the syngas is injected belowground.

8. The method of claim 7 further comprising:

using recovered heat from the syngas to generate power.

9. The method of claim 1 further comprising:

separating upgraded oil into heavy ends and light ends for sales wherein the injecting further comprises:

injecting a mixture of oxygen, steam and heavy ends into the injection well.

10. The method of claim 9 further comprising:

emulsifying oxygen with the heavy ends before injecting the mixture of oxygen, steam and heavy ends into the injection well.

11. A method for extracting oil from an underground oil deposit comprising:

injecting a mixture of oxygen, steam and oil into an injection well to upgrade oil in an oil deposit below ground to decrease the viscosity of the oil to produce upgraded oil;

extracting the upgraded oil with a production well to bring upgraded oil aboveground;

monitoring at least one characteristic of the upgraded oil to determine when the at least on characteristic exceed a threshold;

adjusting the mixture of oxygen, steam and oil when the at least one characteristic exceeds the threshold value so that the mixture of oxygen, steam and oil does not exceed the threshold; and wherein the monitoring further comprises:

monitoring the America Petroleum Institute (API) gravity of the upgrade oil.

12. A method for extracting oil from an underground oil deposit comprising:

injecting a mixture of oxygen, steam and oil into an injection well to upgrade oil in an oil deposit below ground to decrease the viscosity of the oil to produce upgraded oil;

extracting the upgraded oil with a production well to bring upgraded oil aboveground;

monitoring at least one characteristic of the upgraded oil to determine when the at least on characteristic exceed a threshold;

adjusting the mixture of oxygen, steam and oil when the at least one characteristic exceeds the threshold value so that the mixture of oxygen, steam and oil does not exceed the threshold; and wherein the injecting further comprises:

injecting syngas comprised primarily of hydrogen and carbon monoxide, wherein the ratio of hydrogen to carbon monoxide is about 2.5 to 1.

13. An apparatus for extracting oil from an oil deposit beneath ground comprising:

an injection well for injecting a syngas mixture into the oil deposit, wherein the syngas mixture at least partially hydrogenates and cracks oil in the oil deposit creating upgraded oil;

a production well to extract the upgraded oil and bring the upgraded oil aboveground;

monitor logic to monitor at least one characteristic of the upgraded oil and to determine when the at least one characteristic exceeds a threshold value; and control logic to adjust the syngas mixture when the at least one characteristic exceeds the threshold value to adjust the at least one characteristic so that the threshold value is not exceeded.

14. The apparatus of claim 13 wherein the control logic is configured to adjust an amount of oxygen, steam and oil that is injected into the oil deposit.

15. The apparatus of claim 13 further comprising:

a gasifier to mix oxygen, steam and oil to create the syngas, wherein the gasifier is configured to at least partially combust the mixture of oxygen, steam and oil.

16. The apparatus of claim 13 further comprising:

a heat exchanger to lower the heat of the syngas before the syngas is injected belowground.

17. The apparatus of claim 16 further comprising:

a generator to convert heat extracted from the syngas by the heat exchanger into power.

18. An apparatus for extracting oil from an oil deposit beneath ground comprising:

an injection well for injecting a syngas mixture into the oil deposit, wherein the syngas mixture at least partially hydrogenates and cracks oil in the oil deposit creating upgraded oil;

a production well to extract the upgraded oil and bring the upgraded oil aboveground;

monitor logic to monitor at least one characteristic of the upgraded oil and to determine when the at least one characteristic exceeds a threshold value; and control logic to adjust the syngas mixture when the at least one characteristic exceeds the threshold value to adjust the at least one characteristic so that the threshold value is not exceeded; and wherein the monitoring logic is configured to monitor the America Petroleum Institute (API) gravity of the upgrade oil.

19. An apparatus for extracting oil from an oil deposit beneath ground comprising:

an injection well for injecting a syngas mixture into the oil deposit, wherein the syngas mixture at least partially hydrogenates and cracks oil in the oil deposit creating upgraded oil;

a production well to extract the upgraded oil and bring the upgraded oil aboveground;

monitor logic to monitor at least one characteristic of the upgraded oil and to determine when the at least one characteristic exceeds a threshold value; and control logic to adjust the syngas mixture when the at least one characteristic exceeds the threshold value to adjust the at least one characteristic so that the threshold value is not exceeded; and a gasifier to mix oxygen, steam and oil to create the syngas, wherein the control logic is configured to adjust the at least one of: the temperature and the pressure of the mixture of oxygen, steam and oil when the at least one characteristic exceeds the threshold value.

20. An apparatus for extracting oil from an oil deposit beneath ground comprising:

an injection well for injecting a syngas mixture into the oil deposit, wherein the syngas mixture at least partially hydrogenates and cracks oil in the oil deposit creating upgraded oil;

a production well to extract the upgraded oil and bring the upgraded oil aboveground;

monitor logic to monitor at least one characteristic of the upgraded oil and to determine when the at least one characteristic exceeds a threshold value; and control logic to adjust the syngas mixture when the at least one characteristic exceeds the threshold value to adjust the at least one characteristic so that the threshold value is not exceeded; and wherein the monitor logic is an API gravity meter.

* * * * *